United States Patent [19]

Pahl

[11] 4,253,807

[45] Mar. 3, 1981

[54] FLUID PRESSURE OPERATED WHEEL DRIVE

[75] Inventor: James H. Pahl, Wayzata, Minn.

[73] Assignee: Eaton Corporation, Cleveland, Ohio

[21] Appl. No.: 60,269

[22] Filed: Jul. 25, 1979

Related U.S. Application Data

[63] Continuation-in-part of Ser. No. 853,374, Nov. 21, 1977, Pat. No. 4,171,938.

[51] Int. Cl.[3] ..... F03C 2/22; B60K 7/00

[52] U.S. Cl. ..... 418/61 B; 418/102; 180/308

[58] Field of Search ..... 418/61 B, 102; 180/308

[56] References Cited

U.S. PATENT DOCUMENTS

| | | | |
|---|---|---|---|
| 3,598,509 | 8/1971 | Goff et al. | 418/61 B |
| 3,601,513 | 8/1971 | White, Jr. | 418/61 B |
| 3,653,454 | 4/1972 | Nielsen | 180/308 |
| 3,749,195 | 7/1973 | Vegners | 418/61 B |
| 4,035,113 | 7/1977 | McDermott | 418/61 B |

FOREIGN PATENT DOCUMENTS

| | | | |
|---|---|---|---|
| 1553285 | 1/1970 | Fed. Rep. of Germany | 418/61 B |
| 2502104 | 7/1975 | Fed. Rep. of Germany | 418/61 B |

*Primary Examiner*—John J. Vrablik

*Attorney, Agent, or Firm*—R. J. McCloskey; J. Yakimow; L. Kasper

[57] ABSTRACT

A fluid pressure operated wheel motor is disclosed of the type including a stationary housing assembly (11) and a rotatable housing assembly (13), which includes a gerotor displacement mechanism (29). The gerotor ring (47) is part of the rotatable housing assembly and rotates, while the gerotor star (49) is connected by a dogbone shaft (57) to the stationary housing assembly and only orbits. The dogbone shaft defines an axial bore (67), and the stationary housing defines a pair of main fluid passages (71 and 73) which cooperate with a plurality of fluid passages (91 and 93) defined by the rotatable housing assembly to form commutating valving. In either direction of operation, the system fluid flows through the chamber (19) in which the dogbone is disposed. The system fluid is divided into two portions, with one portion flowing through one spline connection (59 and 63), and the other portion flowing through the axial bore and the other spline connection (61 and 65). The two portions then recombine and continue to flow through the motor. Flowing substantially all of the system fluid through the two spline connections greatly improves the lubrication of the splines, and substantially decreases the operating temperature thereof, thereby increasing the torque capacity of the motor.

11 Claims, 5 Drawing Figures

FIG. 4
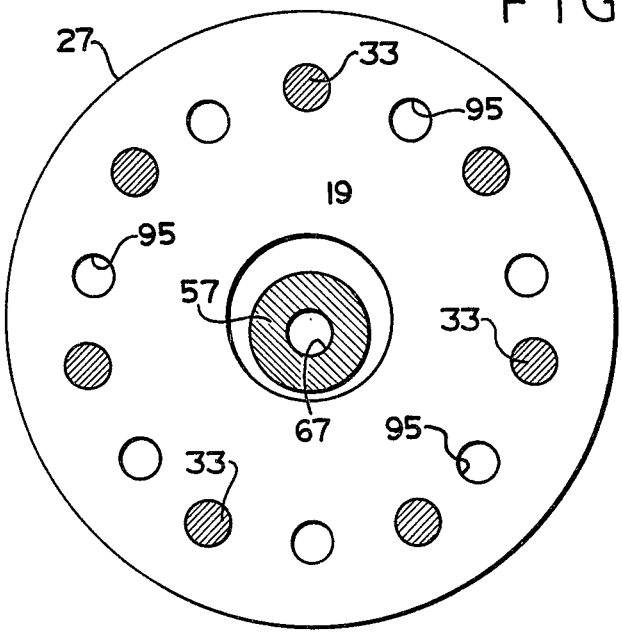
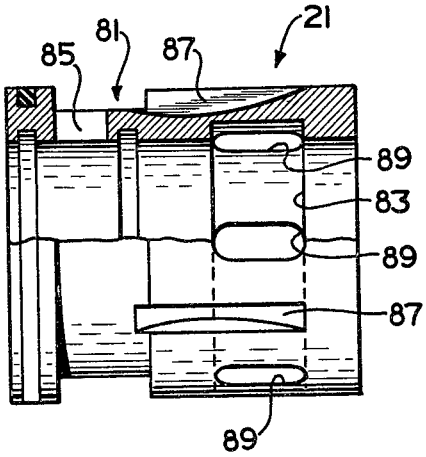
FIG. 5

FLUID PRESSURE OPERATED WHEEL DRIVE

CROSS REFERENCE TO RELATED APPLICATION

This application is a continuation-in-part of U.S. application Ser. No. 853,374, filed Nov. 21, 1977 now U.S. Pat. No. 4,171,938.

BACKGROUND OF THE DISCLOSURE

The present invention relates to rotary fluid pressure operated devices, and more particularly, to such devices which include an internal gear set, two relatively rotatable housing portions, and a shaft member for transmitting torque therebetween.

Although it should become apparent from the subsequent description of the present invention that it may be useful with many types of configurations of fluid pressure devices, the invention is especially advantageous when used in a wheel motor, and will be described in connection therewith.

Also, although the invention may be used with devices having various types of internal gear sets, such as those of the crescent type, the invention is especially adapted for use in a device including a gerotor gear set, and will be described in connection therewith.

Furthermore, although the invention may be used in devices having various configurations of commutating valving, such as rotating disc valves, it is especially suited for use in devices having cylindrical spool valves, and will be described in connection therewith.

Fluid pressure operated wheel motors of the type utilizing a gerotor displacement mechanism to convert fluid pressure into a rotary output have now become well known, and are especially suited for low speed, high torque applications. In most of the known wheel motor designs of this type, one of the primary factors limiting the torque output capability of the motor is the strength of the torque transmitting connection between the stationary portion and the rotating portion. Typically, this drive connection comprises a set of internal splines defined by the gerotor star, a set of internal splines defined by the stationary housing portion, and a main drive shaft (dogbone) having a set of external splines at each end thereof, in engagement with the sets of internal splines. Generally, the internal splines are straight, whereas the external splines are crowned to take into account the angle at which the drive shaft is oriented relative to the axis of rotation of the motor. Therefore, although the invention may be used with devices in which the externally toothed star member merely rotates about its axis, and the dogbone merely rotates about its axis, the invention is especially advantageous when used in a device in which the star member orbits relative to the internally toothed ring member, and the dogbone nutates or wobbles, and the invention will be described in connection therewith.

One of the primary reasons for the limited torque capability of prior art wheel motors is the heat buildup which occurs as a result of the engagement between the internal and external splines. The heat buildup problem is worsened in wheel motors wherein the gerotor ring rotates, and the dogbone must prevent rotation of the gerotor star, relative to the stationary housing portion, permitting only orbital movement of the gerotor star. The result is a continual rubbing movement of the external splines against the internal splines, which causes substantial frictional heat.

In prior art wheel motors, the internal-external spline connections have not had sufficient lubrication. One reason is that they are frequently located in the end of a blind bore, so that any lubricating fluid which is leaked into the bore is likely to remain stagnant around the spline connection, rather than transmitting heat and contamination particles away from the spline connection.

The problem of insufficient lubrication of the spline connections becomes especially serious when the motor is operating at relatively low speeds (e.g., in the range of 5 to 10 rpm), and at high output torque (e.g., 2000 in. lbs.). Under these conditions, the temperature of the spline connection rises, the viscosity of the lubricating fluid drops, and a "break-through" of the oil film may occur, resulting in metal-to-metal contact of the splines. This, in turn, causes even more heat buildup, a further decrease in torque capacity, and possibly, eventual failure of the spline connection.

SUMMARY OF THE INVENTION

Accordingly, it is an object of the present invention to provide a rotary fluid pressure device of the type described, which overcomes the problems of insufficient lubrication of the major torque transmitting connections.

More specifically, it is an object of the present invention to provide a fluid pressure operated wheel motor in which the main torque transmitting connections are lubricated by the main system fluid flow.

The above and other objects of the present invention are accomplished by the provision of an improved rotary fluid pressure device comprising a stationary housing means and a rotatable housing means. The stationary housing means is adapted to be fixed to a vehicle and includes an axially oriented elongated portion defining an axially extending opening. The rotatable housing means is adapted to be connected to a vehicle wheel and is disposed in surrounding relationship to the elongated portion. The rotatable housing means has an internal gear set associated therewith, including an internally-toothed member and an externally-toothed member disposed eccentrically therein. A shaft member is disposed partially within the axially extending opening and has a first end portion cooperating with the elongated portion to define a first connection means and a second end portion cooperating with the externally-toothed member to define a second connection means. The shaft member prevents relative rotation between the stationary housing means and the externally-toothed member and defines an axial bore extending from the first to the second end portion and providing fluid communication therebetween. The stationary housing means defines first and second fluid ports, one of which communicates with the axially extending opening at a first location adjacent the first end portion of the shaft member. The elongated portion of the stationary housing means defines a fluid opening communicating with the axially extending opening at a second location, intermediate the first and second connection means. The stationary and rotatable housing means cooperate to define first fluid passage means providing fluid communication between the first fluid port and one of the expanding and contracting volume chambers and second fluid passage means providing fluid communication between the other of the expanding and contracting volume chambers and the second fluid port. System fluid flows between one of the first and second locations and the other of the first and second locations. A first portion of system fluid flows through the first connection means and a second portion of system fluid flows through the axial bore and the second connection means and recombines with the first portion and flows through the other of the first and second locations. The first and second portions comprise substantially all of the system fluid.

BRIEF DESCRIPTION OF THE DRAWINGS

FIG. 4 is a transverse view taken on line 4—4 of FIG. 1, and on the same scale as FIG. 1.

FIG. 5 is a partially broken away plan view of the valve sleeve shown in FIGS. 1–3, and on the same scale.

DESCRIPTION OF THE PREFERRED EMBODIMENT

Figure 1:
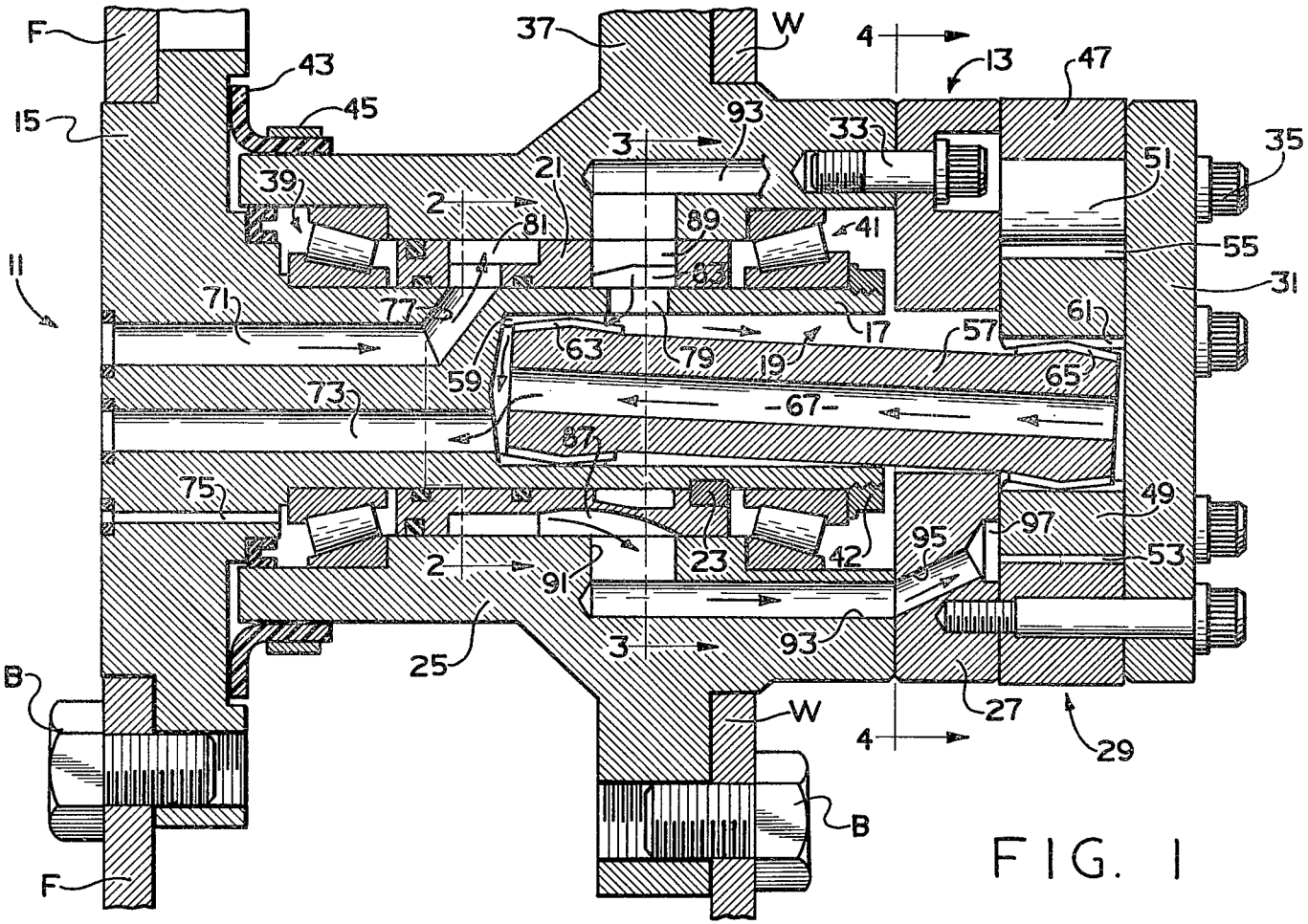
FIG. 1 is an axial cross section of a wheel motor made in accordance with the present invention, with portions of FIG. 1 being taken on line 1—1 of FIG. 2, and other portions of FIG. 1 being taken on line 1—1 of FIG. 3.

Referring now to the drawings, which are not intended to limit the invention, FIG. 1 is an axial cross section of a fluid pressure operated wheel drive (or wheel motor) of the type to which the present invention may be applied. The wheel motor of the present invention includes a stationary housing assembly, generally designated 11, and a rotatable housing assembly, generally designated 13.

The stationary housing assembly 11 includes a mounting flange portion 15 which may be rigidly attached to a vehicle frame member F by means of a plurality of bolts B. Formed integrally with the flange portion 15 is an elongated cylindrical portion 17 which defines an axially-extending opening or chamber 19. Disposed about the cylindrical portion 17 is a cylindrical valve sleeve 21. The cylindrical portion 17 and the valve sleeve 21 are connected by means of a key 23 to prevent relative rotation therebetween, and to give positive valve timing alignment.

The rotatable housing assembly 13 comprises several distinct sections. The assembly 13 includes a valve housing portion 25, a spacer plate 27, a displacement mechanism or gear set 29, and an end cap 31. The spacer plate 27 is held in fluid sealing engagement with the valve housing portion 25 by a plurality of cap screws 33, and the gear set 29 and end cap 31 are held together in fluid sealing engagement with the spacer plate 27 by a plurality of cap screws 35.

Formed integrally with the valve housing portion 25 is a mounting flange portion 37, to which a wheel W may be attached by a plurality of bolts B. The valve housing portion 25 is rotatably supported, relative to the cylindrical portion 17, by a pair of suitable bearing sets, shown herein as a pair of tapered roller bearing sets 39 and 41. A bearing lock nut 42 is in threaded engagement with the end of the cylindrical portion 17, and subjects the bearing sets 39 and 41 to the appropriate axial load. A dust seal 43 is disposed about the valve housing 25, and clamped thereto by means of a band 45. The dust seal 43 slidingly engages the adjacent surface of the mounting flange portion 15 to prevent entry into the motor of particles of dirt and dust.

In the subject embodiment of the present invention, the displacement mechanism or gear set 29 comprises a gerotor gear set, and preferably, a roller gerotor gear set of the type well known in the art. The gear set includes an internally-toothed (ring) member 47, and an externally-toothed (star) member 49, which is disposed eccentrically within the ring member 47. The internal teeth of the ring member 47 comprise a plurality of rollers 51. During relative movement between the ring member 47 and the star member 49, the interengagement of the rollers 51 and the teeth of the star 49 define a plurality of expanding volume chambers 53, and a plurality of contracting volume chambers 55, in a manner well known to those skilled in the gerotor art, and which requires no further description.

Disposed partially within the chamber 19, and partially within the central openings defined by the spacer plate 27 and the star member 49, is a drive shaft 57, commonly referred to as a "dogbone shaft". Adjacent the left end (in FIG. 1) of the chamber 19, the cylindrical portion 17 defines a set of straight internal splines 59, and the star member 49 defines a set of straight internal splines 61. The drive shaft 57 includes a set of external crowned splines 63 in engagement with the internal splines 59, and a set of external crowned splines 65, in engagement with the internal splines 61. The drive shaft 57 further includes an axial bore 67, the function of which will be described subsequently.

Figure 2:
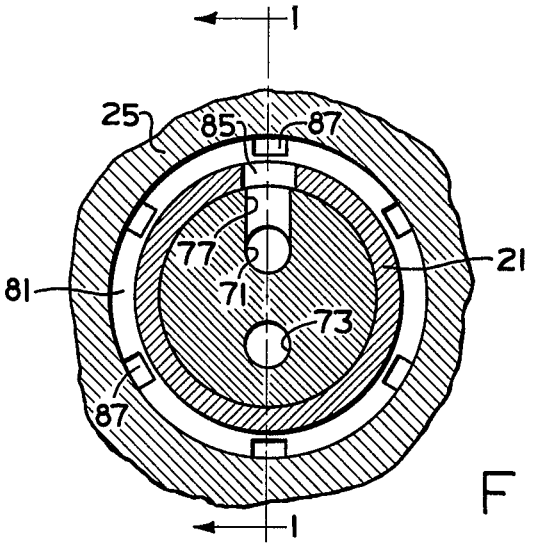
FIG. 2 is a fragmentary, transverse cross section taken on line 2—2 of FIG. 1, and on the same scale as FIG. 1.

The stationary housing assembly 11 defines a pair of main fluid passages 71 and 73, and a case drain passage 75. Each of the passages 71, 73 and 75 terminates at the face of the flange portion 15, and is provided with a suitable O-ring to permit attachment of the flange portion 15 to a manifold (not shown). The fluid passage 71 terminates in an angled portion 77 (see FIG. 2) which extends to the outer periphery of the cylindrical portion 17. The fluid passage 73 is in open fluid communication with the axially-extending chamber 19, such that the chamber 19 comprises a portion of the main fluid flow path, as will be described subsequently. The case drain passage 75 is in fluid communication with the annular chamber defined by the cylindrical portion 17 and the valve housing portion 25, and in which the bearing set 39 is disposed. Just to the right (in FIG. 1) of the internal splines 59, the cylindrical portion 17 defines a radial opening 79, which is in fluid communication with the chamber 19.

Figure 3:
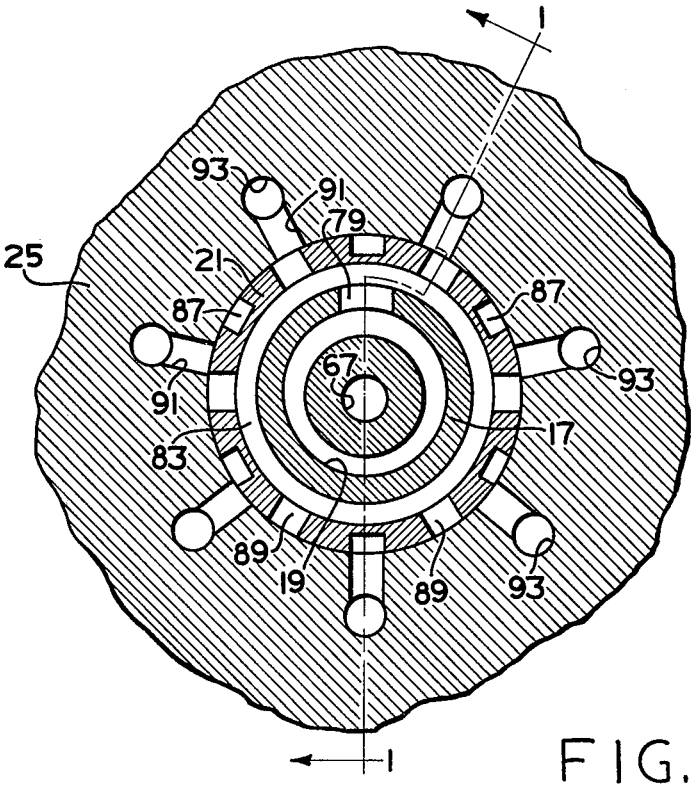
FIG. 3 is a fragmentary, transverse cross section taken on line 3—3 of FIG. 1, and on the same scale as FIG. 1.

The valve sleeve 21 defines an external annular groove 81 (FIGS. 2 and 5), and an internal annular groove 83 (FIGS. 3 and 5). The valve sleeve 21 further defines a radial opening 85 which provides fluid communication between the angled portion 77 and the external annular groove 81. In fluid communication with the groove 81 is a plurality of axial slots 87 (FIGS. 2, 3 and 5), of which there are six in the subject embodiment. The valve sleeve 21 also defines a plurality of radial slots 89 which provide fluid communication between the internal annular groove 83 and the outer periphery of the sleeve 21. In the subject embodiment, because there are six of the axial slots 87, there are also six of the radial slots 89.

Axially aligned with the radial slots 89 are a plurality of radial passages 91 defined by the valve housing portion 25. Each of the radial passages 91 extends radially outwardly to an axial passage 93. Each of the axial passages 93 communicates with an angled passage 95 defined by the spacer plate 27, and each of the angled passages 95 terminates, at its right end in FIG. 1, in a port 97 which provides fluid communication with the adjacent volume chamber 53 and 55. In the subject embodiment, because the gear set 29 defines seven volume chambers 53 or 55 there are seven of the radial passages 91, axial passages 93, angled passages 95 and ports 97. As may best be seen in FIG. 3, the above described arrangement provides for a commutating valving action between the radial passages 91 and the axial slots 87 and radial slots 89, in response to relative rotation between the valve sleeve 21 and valve housing portion 25, as is well known in the art.

Operation

In describing the operation of the present invention, it will be assumed that the fluid passage 71 is connected to a pressurized source of fluid, and that the fluid passage 73 is connected to a fluid return line. Pressurized fluid flows through the passage 71, and through the angled portion 77 and radial opening 85, then fills the external annular groove 81. Pressurized fluid then flows from the annular groove 81 into each of the axial slots 87. As may best be seen in FIG. 3, three of the axial slots 87 are in instantaneous fluid communication with the adjacent radial passages 91, such that the three respective axial passages 93 contain pressurized fluid, which flows to the three respective expanding volume chambers 53.

It will be understood by those skilled in the gerotor gear art that, because the drive shaft 57 prevents rotation of the star member 49, relative to the stationary housing assembly 11, the only movement of the star 49 is orbital. Therefore, during the sequential expansion and contraction of the volume chambers 53 and 55, the resulting movement of the ring member 47 is rotational and therefore, the entire rotatable housing assembly 13 partakes of the same rotational movement as the ring member 47.

Fluid which is exhausted from the contracting volume chambers 55 flows through the adjacent ports 97, angled passages 95, axial passages 93, and radial passages 91. As may best be seen in FIG. 3, three of the radial slots 89 are in instantaneous communication with the three respective radial passages 91. Therefore, return fluid flows through the three radial slots 89 into the internal annular groove 83, then through the radial opening 79 into the axially-extending chamber 19.

As the return fluid enters the chamber 19, it divides into two separate, preferably equal portions. One portion flows to the left in FIG. 1, through the left-hand spline connection (internal splines 59 and external splines 63). The other portion flows to the right in FIG. 1, then through the right-hand spline connection (internal splines 61 and external splines 65). After passing through the right-hand spline connection, the fluid flows over the right end of the shaft 57, then flows through the axial bore 67, as indicated by the arrows in FIG. 1. The portion of fluid which flows through the left-hand spline connection then flows over the left end of the shaft 57 and recombines with the fluid flowing out of the axial bore 67, then enters the fluid passage 73 and returns to the reservoir. For the direction of operation just described, the pressure of the fluid flowing through the spline connections is relatively low, depending partially upon the restriction to fluid flow presented by each of the spline connections. Preferably, the internal splines 59 and 61 are substantially identical, and the external splines 63 and 65 are substantially identical, such that the restriction to fluid flow of the left-hand and right-hand spline connections is substantially identical, and the amount of the two flows is substantially identical.

For the reverse direction of operation, pressurized fluid enters the fluid passage 73 and flows into the chamber 19. One portion of the fluid flows through the left-hand spline connection, then to the radial opening 79, while the other portion of the fluid flows through the axial bore 67, toward the right in FIG. 1, then radially outward over the right end of the shaft 57, through the right-hand spline connection, and to the left toward the radial opening 79, where it recombines with the other portion of pressurized fluid. The pressurized fluid flows out through the radial opening 79 into the internal annular groove 83, then through three of the radial slots 89 which are in communication with the respective radial passages 91. Pressurized fluid flows from the radial passages 91, through the respective axial passages 93 to the expanding volume chambers, as described previously. Fluid returning from the contracting volume chambers flows through the respective axial passages 93, through the radial passages 91, and into three of the axial slots 87. Return fluid flows from the slots 87, filling the external annular groove 81, then flows through the radial opening 85, the angled portion 77, and through the fluid passage 71, to the left in FIG. 1, and returns to the reservoir.

Thus, it may be seen from the foregoing that substantially the entire system flow passing through the motor flows through the left-hand and right-hand spline connections which are the major torque connections in the motor. Utilizing the present invention, each of the spline connections are continually lubricated by a portion of the main system flow passing through the splines and carrying away heat, as well as metal particles and other forms of contamination. A more specific advantage of the present invention is that as the speed of the motor increases, and the frictional heat generated by the splines increases, the fluid flow through the motor, and therefore the flow of lubricant through the splines, increases proportionately. In other words, by use of the invention, the normally harmful effects of increased motor speed are self-compensating.

In utilizing the present invention, it is believed to be within the knowledge of those skilled in the art to modify either the external splines, or the internal splines, or both, in order to provide sufficient flow area through each of the spline connections. It is important to be sure that neither of the spline connections provide so much restriction to the flow of fluid therethrough as to generate a back pressure within the motor (i.e., within the contracting volume chambers 55) which will reduce the torque of the motor. In some situations, it may be desirable to provide for a higher flow rate through one of the connections than through the other, and it is believed to be within the knowledge of those skilled in the art to vary the relative flow rate through the left-hand and right-hand connections, subsequent to a reading and understanding of the present specification. It is also believed to be within the knowledge of those skilled in the art to make various other alterations and modifications of the invention, and it is intended that all such alterations and modifications be included as part of the invention, insofar as they come within the scope of the appended claims.

What is claimed is:

1. A rotary fluid pressure device comprising:

(a) stationary housing means adapted to be rigidly fixed to a vehicle, said stationary housing means including an axially-oriented elongated portion defining an axially-extending opening;

(b) rotatable housing means adapted to be connected to a vehicle wheel, said rotatable housing means being disposed in generally surrounding relationship to said elongated portion;

(c) said rotatable housing means having an internal gear set associated therewith, said internal gear set including an internally-toothed member and an externally-toothed member eccentrically disposed within said internally-toothed member for relative movement therebetween, the teeth of said members interengaging to define expanding and contracting volume chambers during said relative movement;

(d) a shaft member disposed partially within said axially-extending opening and having a first end portion cooperating with said elongated portion to define a first connection means and a second end portion cooperating with said externally-toothed member to define a second connection means, to substantially prevent relative rotation between said stationary housing means and said externally-toothed member, said shaft member defining a generally axial bore extending from said first end portion to said second end portion and providing fluid communication therebetween;

(e) said stationary housing means defining first and second fluid ports, one of said fluid ports communicating with said axially-extending opening, at a first location axially adjacent said first end portion of said shaft member, said elongated portion of said stationary housing means defining a fluid opening communicating with said axially-extending opening, at a second location intermediate said first and second connection means;

(f) said stationary housing means and said rotatable housing means cooperating to define first fluid passage means providing fluid communication between said first fluid port and one of said expanding and contracting volume chambers, and second fluid passage means providing fluid communication between the other of said expanding and contracting volume chambers and said second fluid port; and (g) system fluid flowing between one of said first location and said second location and the other of said first location and said second location, a first portion of system fluid flowing through said first connection means, and a second portion of system fluid flowing through said axial bore and said second connection means and recombining with said first portion, and flowing through the other of said first and second locations, said first and second portions comprising substantially all of said system fluid.

2. A device as claimed in claim 1 wherein said internal gear set comprises a gerotor gear set.

3. A device as claimed in claim 2 wherein said relative movement of said toothed members comprises said internally-toothed member rotating and said externally-toothed member rotating.

4. A device as claimed in claim 2 wherein each of said first and second connection means comprises a universal-type connection.

5. A device as claimed in claim 4 wherein each of said first and second connection means comprises a set of internal splines and a set of crowned external splines.

6. A device as claimed in claim 1 wherein said elongated portion defines a first set of internal splines and said first end portion of said shaft member defines a first set of crowned external splines, said first internal and external splines comprising said first connection means.

7. A device as claimed in claim 1 or 6 wherein said externally-toothed member defines a second set of internal splines and said second end portion of said shaft member defines a second set of crowned external splines, said second internal and external splines comprising said second connection means.

8. A device as claimed in claim 1 wherein said first and second connection means define first and second flow restrictions, respectively, said first and second flow restrictions being approximately equal, whereby said first and second portions of said system fluid are approximately equal.

9. A device as claimed in claim 1 wherein said stationary housing means and said rotatable housing means define commutating valve means during rotation of said rotatable valve means.

10. A device as claimed in claim 9 wherein said rotatable housing means defines a fluid passage communicating with each of said volume chambers and said stationary housing means defines a plurality of fluid passages corresponding to the number of teeth of said externally-toothed member, the interaction of said fluid passages defined by said rotatable housing means and said fluid passages defined by said stationary housing means comprising said commutating valve means.

11. A rotary fluid pressure device comprising:

(a) stationary housing means adapted to be rigidly fixed to a vehicle, said stationary housing means including an axially-oriented elongated portion defining an axially-extending opening;

(b) rotatable housing means adapted to be connected to a vehicle wheel, said rotatable housing means being disposed in generally surrounding relationship to said elongated portion;

(c) said rotatable housing means having an internal gear set associated therewith, said internal gear set including an internally-toothed member and an externally-toothed member eccentrically disposed within said internally-toothed member for relative movement therebetween, the teeth of said members interengaging to define expanding and contracting volume chambers during said relative movement;

(d) a shaft member disposed partially within said axially-extending opening and having a first end portion cooperating with said elongated portion to define a first connection means and a second end portion cooperating with said externally-toothed member to define a second connection means, to substantially prevent relative rotation between said stationary housing means and said externally-toothed member, said shaft member defining a generally axial bore extending from said first end portion to said second end portion and providing fluid communication therebetween;

(e) said stationary housing means defining first and second fluid ports, one of said fluid ports communicating with said axially-extending opening, at a first location axially adjacent said first end portion of said shaft member, said elongated portion of said stationary housing means defining a fluid opening communicating with said axially-extending opening, at a second location intermediate said first and second connection means;

(f) said stationary housing means and said rotatable housing means cooperating to define first fluid passage means providing fluid communication between said first fluid port and one of said expanding and contracting volume chambers, and second fluid passage means providing fluid communication between the other of said expanding and contracting volume chambers and said second fluid port; and (g) in one direction of operation of said device, system fluid flowing from said first location, a first portion thereof flowing through said first connection means, and a second portion thereof flowing through said axial bore, through said second connection means and recombining with said first portion and flowing through said second location, said first and second portions comprising substantially all of said system fluid; or (h) in another direction of operation of said device, system fluid flowing from said second location, a first portion thereof flowing through said first connection means, and a second portion thereof flowing through said second connection means, through said axial bore and recombining with said first portion and flowing through said first location, said first and second portions comprising substantially all of said system fluid.

* * * * *